US007400302B2

(12) United States Patent
Winter

(10) Patent No.: US 7,400,302 B2
(45) Date of Patent: Jul. 15, 2008

(54) INTERNAL ANTENNA FOR HANDHELD MOBILE PHONES AND WIRELESS DEVICES

(75) Inventor: James Blake Winter, Lincoln, NE (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 196 days.

(21) Appl. No.: 11/343,167

(22) Filed: Jan. 30, 2006

(65) Prior Publication Data

US 2007/0176830 A1 Aug. 2, 2007

(51) Int. Cl.
*H01Q 1/24* (2006.01)
*H01Q 1/48* (2006.01)

(52) U.S. Cl. ..... 343/702; 343/846

(58) Field of Classification Search ..... 343/846, 343/702, 850, 860, 767; 455/575.5, 575.7
See application file for complete search history.

(56) References Cited

U.S. PATENT DOCUMENTS

| | | | | |
|---|---|---|---|---|
| 3,568,201 | A | 3/1971 | Spoonamore | |
| 3,573,628 | A | 4/1971 | Cramer, Jr. et al. | |
| 4,063,246 | A | 12/1977 | Greiser | |
| 4,197,544 | A | 4/1980 | Kaloi | |
| 4,571,595 | A | 2/1986 | Phillips et al. | |
| 4,746,925 | A | 5/1988 | Toriyama | |
| 5,081,466 | A | 1/1992 | Bitter, Jr. | |
| 5,337,061 | A | 8/1994 | Pye et al. | |
| 5,386,214 | A | 1/1995 | Sugawara | |
| 5,483,678 | A | 1/1996 | Abe | |
| 6,239,764 | B1 | 5/2001 | Timofeev et al. | |
| 6,297,774 | B1 | 10/2001 | Chung | |
| 6,373,436 | B1 | 4/2002 | Chen et al. | |
| 6,466,176 | B1 | 10/2002 | Maoz et al. | |
| 7,012,571 | B1 * | 3/2006 | Ozkar et al. | 343/702 |
| 7,109,945 | B2 * | 9/2006 | Mori | 343/861 |
| 7,184,808 | B2 * | 2/2007 | Shoji | 455/575.7 |
| 7,199,762 | B2 * | 4/2007 | Liu et al. | 343/702 |
| 2007/0021161 | A1 * | 1/2007 | Autti | 455/575.7 |

FOREIGN PATENT DOCUMENTS

| | | |
|---|---|---|
| WO | WO 99/54656 | 10/1999 |
| WO | WO 99/54956 | 10/1999 |

* cited by examiner

*Primary Examiner*—Hoang V Nguyen
(74) *Attorney, Agent, or Firm*—Holland & Hart LLP

(57) ABSTRACT

An antenna for a foldable wireless device is provided. The foldable wireless device and antenna include a first housing and a second housing pivotally connected. A printed circuit board associated with the wireless device comprises a first PCB in the first housing and a second PCB in the second housing. The first and second PCB function as first and second radiating plates respectively. A gap, generally aligned with the pivotal connection separates the first and second PCBs. A short is provided that traverses the gap and connects the first and second PCBs. Radio frequency power is connected to the first and second PCB to supply radio frequency power.

21 Claims, 2 Drawing Sheets

INTERNAL ANTENNA FOR HANDHELD MOBILE PHONES AND WIRELESS DEVICES

STATEMENT REGARDING FEDERALLY SPONSORED RESEARCH

None

CROSS-REFERENCE TO RELATED APPLICATIONS

Not related to any currently pending patent applications or issued patents.

FIELD OF THE INVENTION

The present invention relates to antenna for wireless devices and, more particularly, to an antenna capable of receiving digital television signals.

BACKGROUND OF THE INVENTION

Cellular phones, PDAs, BLACKBERRYs® from Research in Motion, wireless computers, handheld computers and the like are becoming increasingly prevalent in today's society. The uses for such devices include both business uses as well as personal uses. Only a few years ago, wireless devices were relatively limited in use, but today a single wireless device may incorporate features to allow functions such as, for example, cellular communication, internet access, text messaging, credit purchases, bank account access, television viewing, computing, video gaming, navigation information, and the like.

With the increase in consumer use of wireless devices over multiple functions, the need for those devices to operate over multiple radio frequency bandwidths also has increased. Thus, it is not uncommon for wireless devices to incorporate antennas for various frequency bands such as ISM band, Bluetooth band, GPS band, 802.11 band, other cellular bands and the like.

While users of wireless devices are demanding that wireless devices be more versatile and perform more functions, they are concurrently demanding that the wireless devices become lighter, smaller, and generally more compact. Decreasing the size of the wireless device while increasing the number of functions is increasingly difficult. Moreover, to accommodate the increase in electronic components, the manufacturers are increasingly restricting the space available for radio frequency antennas. Thus, it would be desirous to develop improved antennas for one or more of the various wireless functions associated with today's wireless devices.

SUMMARY OF THE INVENTION

To attain the advantages of and in accordance with the purpose of the present invention, a planar antenna for a foldable wireless device is provided. The foldable wireless device and antenna include a first housing and a second housing pivotally connected. A ground plane, which may be a printed circuit board, associated with the wireless device comprises a first ground plane in the first housing and a second ground plane in the second housing. The first and second ground plane function as first and second radiating plates respectively. A gap, generally aligned with the pivotal connection separates the first and second ground planes. A short is provided that traverses the gap and connects the first and second ground planes.

The foregoing and other features, utilities and advantages of the invention will be apparent from the following more particular description of a preferred embodiment of the invention as illustrated in the accompanying drawings.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTION

The improved antenna for a flip style wireless device will be described with references to the figures. For convenience the antenna is shown and described in relation to a flip style cellular telephone. However, one of ordinary skill in the art on reading the disclosure will now recognize that alternative flip style wireless devices could benefit from the antenna described. Other wireless devices include, for example, laptop computers, portable televisions, PDAs, BLACKBERRYs®, handheld computers, pagers, and the like.

Figure 1:
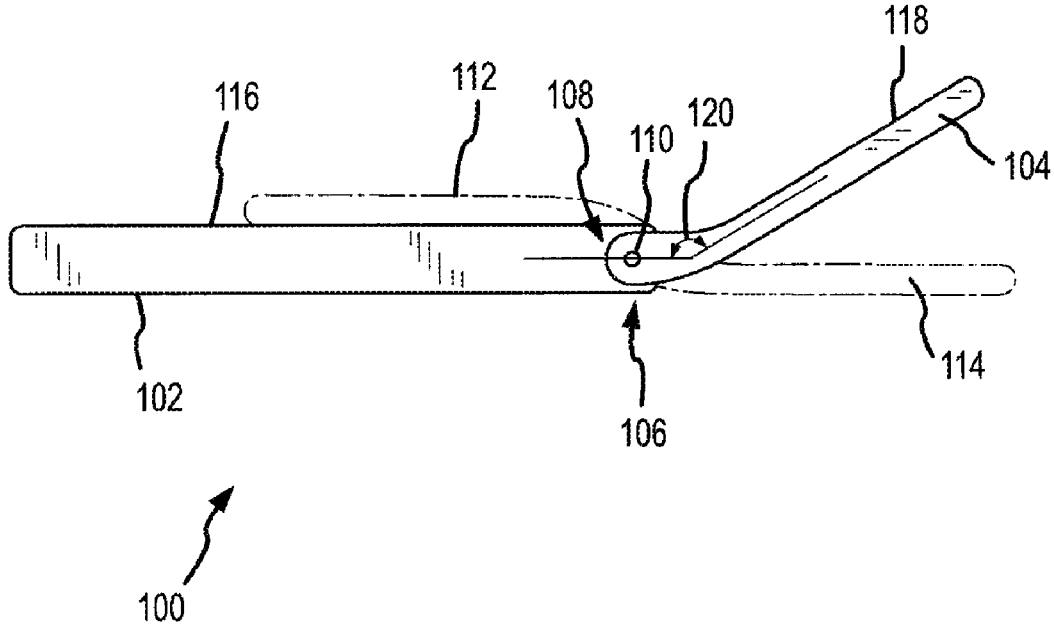
FIG. 1 is a side elevation view of a flip style wireless device.

Referring first to FIG. 1, a side elevation view of a wireless flip device 100 is shown. In this case, device 100 is a cellular telephone, but may be any type of wireless device including those indicated above. Device 100 includes a first (or lower) housing 102 and a second (or upper) housing 104. Upper and lower are relative terms used to distinguish the two parts and should not be construed to limit the orientation of the device. First housing 102 is connected to second housing 104 by a pivotal connection 106. While any number of connections are possible, the pivotal connection shown includes a bore 108, which may be a detent, a through hole, or the like, and a pin 110, which may be an axle or one or more protrusions. Pin 110 acts as an axle to allow second housing 104 to move from a closed position 112 to an open position 114, both shown in phantom. Second housing 104 may have numerous other positions between closed position 112 and open position 114. Also and optionally, open position 114 may be such that a top surface 116 of first housing 102 and a top surface 118 of second housing 104 are substantially coplanar. Alternatively and optionally, top surface 116 and top surface 118 may form an angle 120.

Figure 2:
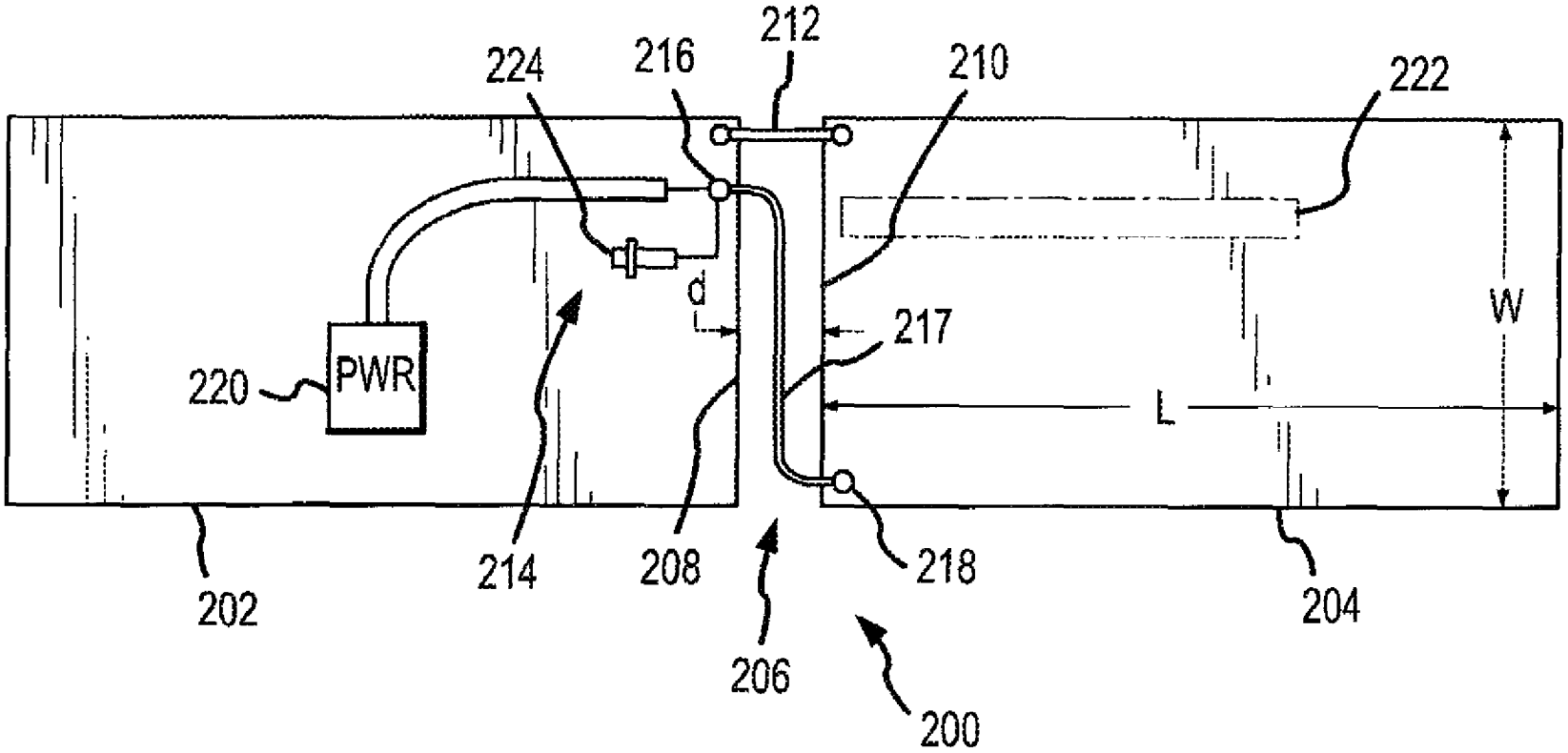
FIG. 2 is a top elevation view of a radiator associated with the flip style wireless device.

Referring now to FIG. 2, a ground plane 200 is shown. For convenience, ground plane 200 is shown as a printed circuit board (PCB), having the device electronics, for wireless device 100. While PCBs are typical ground planes, one or ordinary skill in the art or reading the disclosure will now recognize that the ground plane can be any conventional ground plane having the arranged as described including, the PCB, a metal housing, or the like. For convenience, ground plane and PCB are used interchangeably in the description. PCB 200 includes a first PCB 202 and a second PCB 204. First PCB 202 is housed in first housing 102 and second PCB 202 is housed in second housing 104. A gap 206 resides between first PCB 202 and second PCB 204. Gap 206 generally coincides with pivotal connection 106 such that first PCB 202 and second PCB 204 move in a generally pivotal relation with respect to each other. First PCB 202 has at least a first edge 208 proximate gap 206 and second PCB 204 has at least a second edge 210 proximate gap 206. First PCB 202 and second PCB 204 are electrically connected by a short 212 extending between first edge 208 and second edge 210. The two PCBs, besides functioning as the ground plane and signal routing for the device, form radiators of the device.

In most instances, the antenna transmits and receives simultaneously. In an embodiment of the present device, the antenna receives only. Radio frequency power is supplied or received through a power feed 214 to first PCB 202 at power point 216 on first edge 208 and to second PCB 204 at power point 218 on second edge 208. A wire 217 connects power point 216 and power point 218. Power feed 214 could be any number of radio frequency power transmission structures, such as, for example, a microstrip line, a coaxial cable (as shown), a solder connection, a conductive strip on a circuit board or the like.

Wire 217 connects the two power points and functions as the center conductor of a transmission line formed by edges 208 and 210. The transmission line formed by edges wire 217, edge 208, and edge 210 also forms a portion of the radiator in addition to transforming the impedance between power points 216 and 218. Without wire 217, a short forms at lower operating frequencies between edges 208 and 210, which inhibits operation at lower frequency bands.

RF power may be supplied to power points 216 and 218 by any conventional power source 220 located on first PCB 202. Conventional power source 220 may include signal generators, amplifiers, and modulators. However, as the device can be receive only, the power source is optional.

Radiator 200 can be tuned to particular operating frequencies by varying a length L and width W of the first and second PCBs 202 and 204 as well as increasing or decreasing the size D of gap 206. Moreover, altering a length of wire 217 can be used to tune radiator 200. Moreover, each PCB could have one or more slots (such as slot 222 shown in phantom on PCB 204) to quasi-partition the PCB, but such slots are optional and likely not necessary. While first PCB 202 and second PCB 204 are shown having identical lengths L and widths W, the lengths and widths of each part may vary.

Digital television signals conventionally operate at relatively low frequencies such as 440 MHz to 470 MHz. Radiator 200 is especially useful in receiving digital television signals. For example, if wireless device 100 were a flip cellular phone, a PCB ground plane 200, which coincides with the radiator, becomes a linear inverted-F antenna with a very tall radiating element in nearly the same plane as the ground plane. The above design, while useful in many applications, is especially useful for reception of the low frequency digital television signals. The device can also be configured to operate at the higher digital TV frequencies in the L-band near 1300 MHz.

While useful for receiving digital television signals, the low frequency of the signals and the size of the radiator may require the use of a matching network 224. While any conventional matching network is possible, matching network 224 is shown and includes a varactor diode.

While the antenna has been particularly shown and described with reference to an embodiment thereof, it will be understood by those skilled in the art that various other changes in the form and details may be made without departing from the spirit and scope described herein.

The invention claimed is:

1. A wireless device, the wireless device comprising, a first housing;

a second housing pivotally connected to the first housing;

a ground plane radiator, comprising a first ground plane functioning as a first radiating plate having a first edge in the first housing and a second ground plane functioning as a second radiating plate having a second edge in the second housing such that the first ground plane and the second ground plane move relative to each other;

the ground plane radiator comprising at least one slot in at least one of the first ground plane or the second around plane;

a gap, the gap being located proximate to the first edge and the second edge and separating the first ground plane and the second ground plane by a distance; and a short traversing gap connecting the first ground plane and the second ground plane.

2. The wireless device of claim 1 wherein the wireless device comprises a flip cellular phone.

3. The wireless device of claim 1, wherein the radiator has a radio frequency matching network.

4. The wireless device of claim 3, wherein the matching network includes a varactor diode.

5. The wireless device of claim 1, wherein the radiator receives digital television radio frequency signals.

6. The wireless device of claim 1, wherein the radiator comprises a printed circuit board.

7. The wireless device of claim 1, wherein the short connects the first ground plane and the second ground plane by connecting the first edge to the second edge.

8. The wireless device of claim 1, further comprising a pivotal connection between the first ground plane and the second ground plane to allow the the first ground plane and the second ground plane to move relative to each other wherein the gap is substantially aligned with the pivotal connection.

9. The wireless device of claim 8, wherein the pivotal connection is formed by at least one bore and at least one corresponding protrusion.

10. The wireless device of claim 1, wherein the first ground plane includes a slot.

11. The wireless device of claim 1, wherein the second ground plane includes a slot.

12. The wireless device of claim 1, further comprising a radio frequency power source wherein the radio frequency power feed is selected from a group of radio frequency power feeds consisting of: a coaxial cable, a microstrip line, or a conductive trace.

13. The wireless device of claim 1, wherein at least one metal housing attached to the ground plane radiator comprises the first ground plane and second ground plane.

14. The wireless device of claim 1, further comprising a radio frequency power source coupled to the first ground plane and the second ground plane.

15. The wireless device of claim 1, wherein the ground plane radiator comprises at least a metal housing.

16. An antenna for a wireless device, the antenna comprising:

a ground plane functioning as a radiator, the ground plane comprising a first ground plane radiating plate connected to a second ground plane radiating plate such that the first ground plane radiating plate and the second ground plane radiating plate can move relative to each other;

the ground plane comprising at least one slot in at least one of the first ground plane or the second ground plane;

a gap separates a first edge of the first ground plane radiating plate from a second edge of the second ground plane radiating plate;

a short connecting the first ground plane radiating plate and the second ground plane radiating plate; and a wire functioning as a center connector connecting the first ground plane radiating plate and the second ground plane plate.

17. The antenna of claim 16, wherein the ground plane comprises a printed circuit board (PCB), and the first ground plane radiating plate is a first PCB radiating plate, and the second ground plane is a second PCB radiating plate.

18. The antenna of claim 17, wherein the first PCB radiating plate is connected to the second PCB radiating plate by a short coupled to an edge of the first PCB radiating plate and an edge of the second PCB radiating plate.

19. The antenna of claim 17, wherein the wire is coupled to an edge of the first PCB radiating plate and an edge of the second PCB radiating plate.

20. The antenna of claim 17, wherein the first PCB radiating plate and the second PCB radiating plate reside in substantially the same plane during operation of the antenna.

21. The antenna of claim 16 further comprising a radio frequency power source coupled to the first ground plane radiating plane and the second ground plane radiating plate.

* * * * *